US010485718B2

(12) United States Patent
Provda et al.

(10) Patent No.: US 10,485,718 B2
(45) Date of Patent: Nov. 26, 2019

(54) CONVERTIBLE MOBILE EXERCISER

(71) Applicants: Asher B. Provda, Brightwaters, NY (US); Alexander S. Provda, Wooland Hills, CA (US); Randall Scott Hinden, Merrick, NY (US)

(72) Inventors: Asher B. Provda, Brightwaters, NY (US); Alexander S. Provda, Wooland Hills, CA (US); Randall Scott Hinden, Merrick, NY (US)

( * ) Notice: Subject to any disclaimer, the term of this patent is extended or adjusted under 35 U.S.C. 154(b) by 113 days.

(21) Appl. No.: 15/790,990

(22) Filed: Oct. 23, 2017

(65) Prior Publication Data

US 2019/0118031 A1 Apr. 25, 2019

(51) Int. Cl.

| | |
|---|---|
| ***A61G 5/02*** | (2006.01) |
| ***A63B 22/06*** | (2006.01) |
| ***A63B 22/00*** | (2006.01) |

(52) U.S. Cl.

CPC ..... *A61G 5/027* (2013.01); *A63B 22/0017* (2015.10); *A63B 22/0605* (2013.01)

(58) Field of Classification Search

CPC ..... A61G 5/027

See application file for complete search history.

(56) References Cited

U.S. PATENT DOCUMENTS 3,423,086 A * 1/1969 Moore ..... A61G 5/10 280/288.4
5,273,304 A * 12/1993 Berkheimer ..... A61G 5/023 280/233
5,324,060 A * 6/1994 Van Vooren ..... A61G 5/023 280/304.1
6,092,822 A * 7/2000 Salmon ..... A61G 5/023 280/250.1
6,142,914 A * 11/2000 Crawford ..... A61H 1/0214 280/304.1
6,196,565 B1 * 3/2001 Chubbuck ..... A61G 5/02 280/255
7,066,480 B2 6/2006 Brichet et al.
7,293,623 B2 * 11/2007 Berkelmans ..... B62K 3/005 180/230
7,635,142 B2 * 12/2009 Slagerman ..... A61G 5/12 280/291
7,922,187 B2 * 4/2011 Fremgen ..... A61G 5/023 280/250.1

(Continued)

FOREIGN PATENT DOCUMENTS

JP 2008011989 A * 1/2008

*Primary Examiner* — Kevin Hurley
(74) *Attorney, Agent, or Firm* — Stephen E. Feldman; Feldman Law Group, P.C.

(57) ABSTRACT

The specification relates to a mobile exerciser. The mobile exerciser can include a mobile exerciser frame; a foot rest assembly attached to the mobile exerciser frame having a working position and a stored position; and a pedal assembly attached to the mobile exerciser frame having a working position and a stored position. The mobile exerciser can be converted from a push mode to a pedal mode by moving the foot rest assembly into a stored position and the pedal assembly into a working position and the mobile exerciser can be converted from a pedal mode to a push mode by moving the foot rest assembly into a working position and the pedal assembly into a stored position.

20 Claims, 22 Drawing Sheets

(56) References Cited

U.S. PATENT DOCUMENTS

| | | | | |
|---|---|---|---|---|
| 8,251,393 | B2 * | 8/2012 | Fremgen | A61G 5/023 280/250.1 |
| 8,517,407 | B2 | 8/2013 | Handa et al. | |
| 9,387,139 | B2 * | 7/2016 | Chang | A61G 5/023 |
| 9,693,914 | B2 * | 7/2017 | Ooyama | A61G 5/1021 |
| 2008/0246246 | A1 * | 10/2008 | Dix | A61G 5/023 280/233 |
| 2011/0018221 | A1 * | 1/2011 | Anooshian | A61G 5/08 280/250.1 |
| 2016/0106606 | A1 * | 4/2016 | Eddy | A61G 5/101 280/250.1 |

* cited by examiner

CONVERTIBLE MOBILE EXERCISER

BACKGROUND

The disclosed technology relates generally to a convertible mobile exerciser.

It is well-known that cycling is an excellent rehabilitation technique for knee injuries, leg injuries or any other leg ailments in which cyclical movement will improve muscle tone and strength. All of the major muscles of the legs are used at one point or another during cycling but the major muscles that are used for generating power are the quadriceps group. During the pedal cycle the quadriceps mainly work as you push the pedal down and straighten your leg while the hamstrings at the back of thigh work to bend the knee. By using cycling within a rehabilitation program, the leg muscles can be strengthened while controlling the amount of stresses to the knee and other leg parts. For example, knees can benefit from the cyclical movement without applying excessive forces so that articular cartilage covering the ends of your bones can get nourished. Cycling has also been shown to be a relatively safe activity for rehabilitation after anterior cruciate ligament (ACL) reconstruction as the strain that is placed on the ACL during cycling at rehabilitation levels is relatively low.

Recumbent cycles allow a user to sit in a chair with a backrest and provide an exercise alternative for individuals who cannot sit safely on a stationary bike. There is no difference in the range of motion at the knee between recumbent and upright cycling. However, the change in position does alter the direction that forces are applied to the knee joint resulting in less load being placed on the leg muscles and ligaments during recumbent cycling. It has therefore been suggested that recumbent cycling may be preferential to upright cycling for some rehabilitation therapies.

While the benefit of recumbent cycling is excellent, the user can spend many hours on the bike every week which tends to become boring and repetitive. This can lead to some users not spending the time they need for rehabilitation on the stationary bike.

SUMMARY

This specification describes technologies relating to a convertible mobile exerciser. The convertible mobile exerciser, described herein, allows a user to benefit from recumbent cycling while allowing the user to become more free and independent during their rehabilitation period. That is, the convertible mobile exerciser allows the user to pedal the mobile exerciser in most spaces, e.g., department stores, homes, offices, etc., and build strength in the user's legs for rehabilitation purposes. When done exercising or fatigued, the mobile exerciser can be easily converted into a transporter and be pushed by a second person.

In one implementation, a mobile exerciser comprising: a mobile exerciser frame; a foot rest assembly attached to the mobile exerciser frame, the foot rest assembly having a working position and a stored position; and a pedal assembly attached to the mobile exerciser frame, the pedal assembly having a working position and a stored position, wherein the mobile exerciser is converted from a push mode to a pedal mode by moving the foot rest assembly into the stored position and the pedal assembly into the working position and the mobile exerciser is converted from a pedal mode to a push mode by moving the foot rest assembly into the working position and the pedal assembly into the stored position.

In some implementations, the foot rest assembly further includes a telescoping rod, the telescoping rod being extended from the mobile exerciser frame when converting the foot rest assembly from the stored position into the working position. In some implementations, the telescoping rod is secured with a clamp when in a working position.

In some implementations, the foot rest assembly further includes a foot rest, the foot rest being twisted 90 degrees when converting the foot rest assembly from the stored position into the working position. In some implementations, the foot rest assembly is secured with a push button mechanism.

In some implementations, the pedal assembly can further include a crank shaft having pedals, the pedals being removed when converting the pedal assembly from the working position into the stored position.

In some implementations, the pedal assembly can further include a crank shaft having a chain tension release, the chain tension release releasing tension on a chain when converting the pedal assembly from the working position into the stored position.

Some implementations also comprise: a steering assembly for controlling a direction of a rear wheel of the mobile exerciser. Some implementations also comprise: a braking assembly, the braking assembly controlling a brake of the rear wheel.

The advantages of the convertible mobile exerciser is that it allows a user to benefit from recumbent cycling while also allowing the user to become more free and independent during their rehabilitation period.

DETAILED DESCRIPTION

Figure 1:
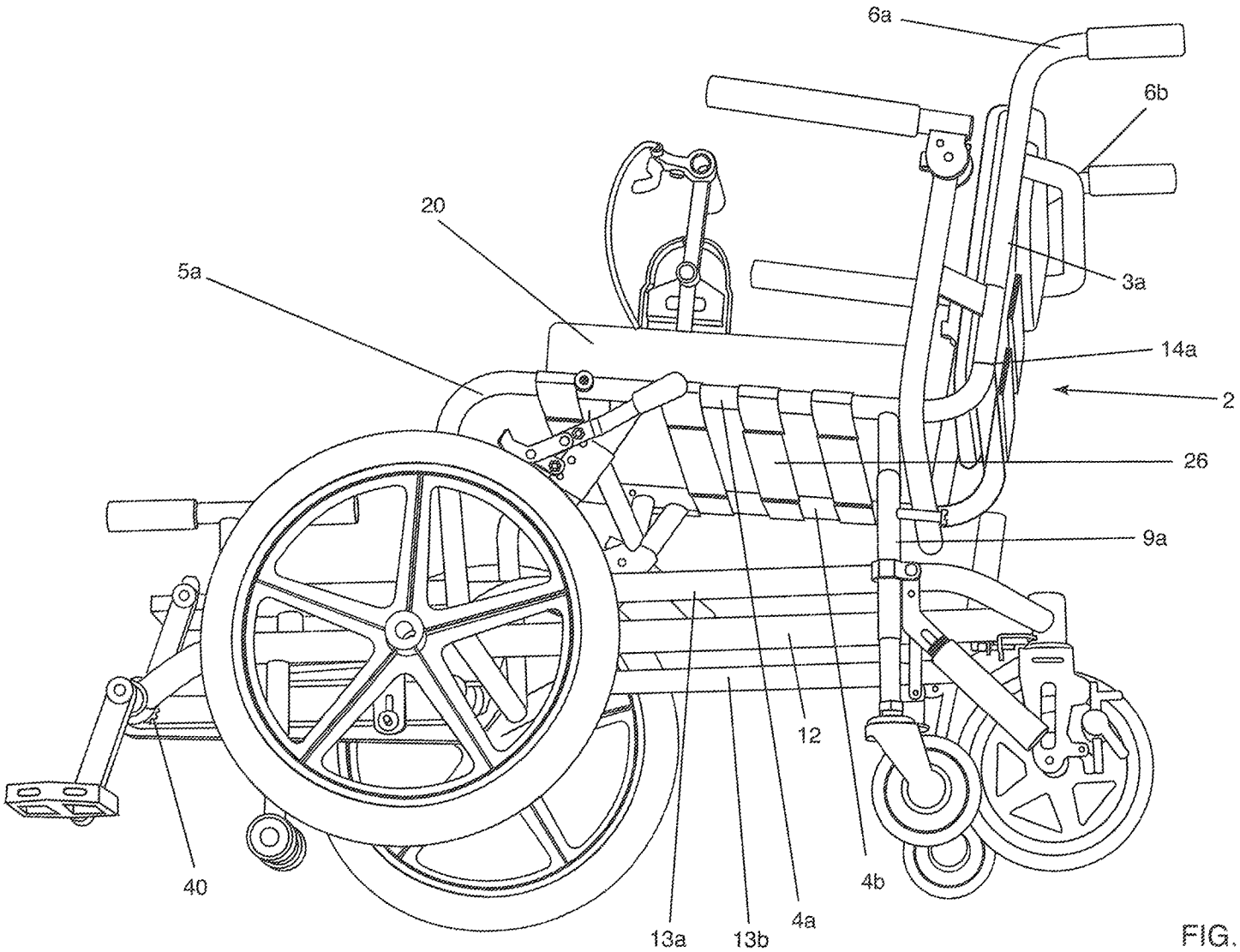
FIG. 1 is a left-side view of a convertible mobile exerciser of the disclosed technology.
Figure 2:
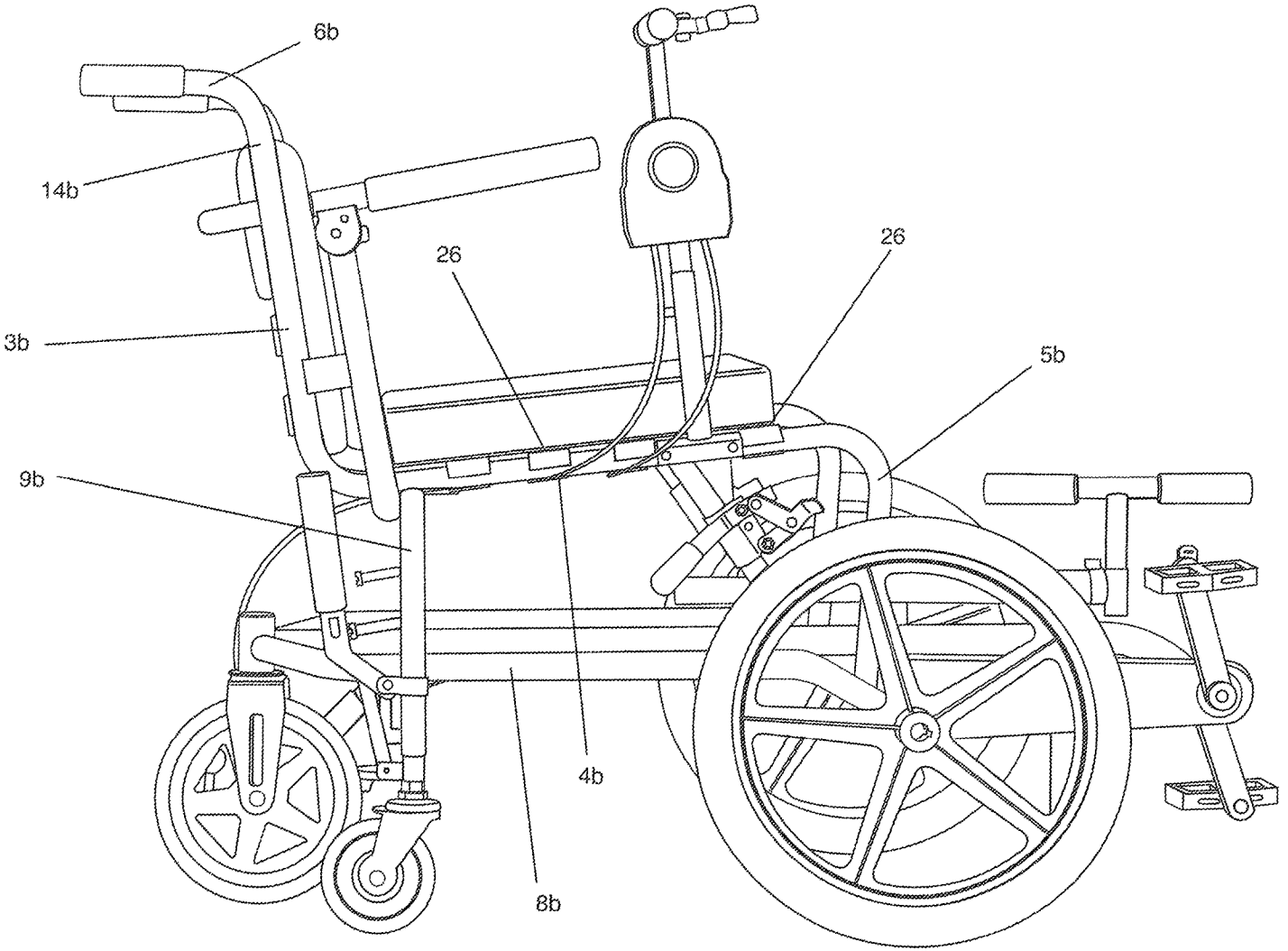
FIG. 2 is a right-side view of a convertible mobile exerciser of the disclosed technology.
Figure 3:
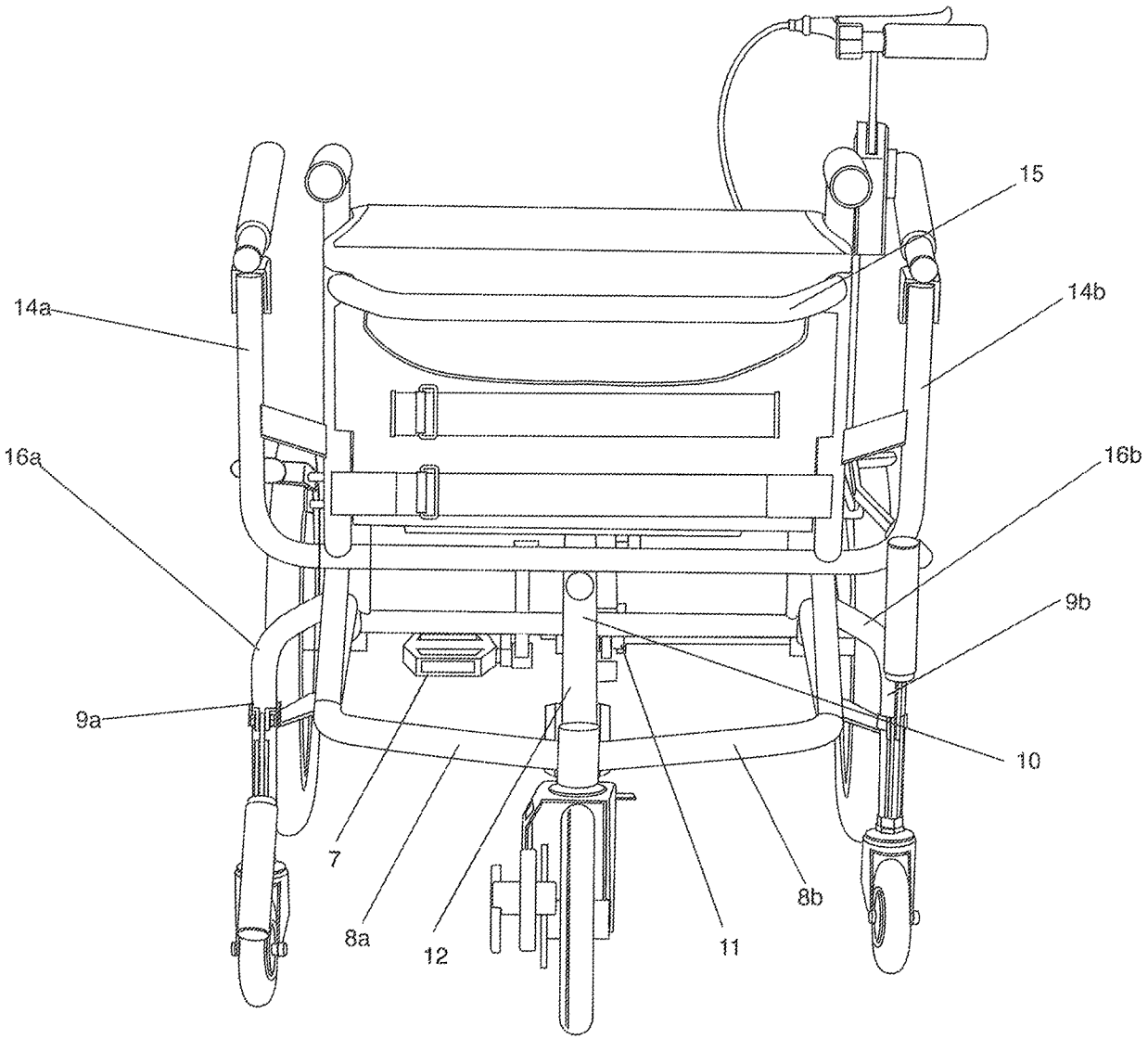
FIG. 3 is a rear view of a convertible mobile exerciser of the disclosed technology.
Figure 4:
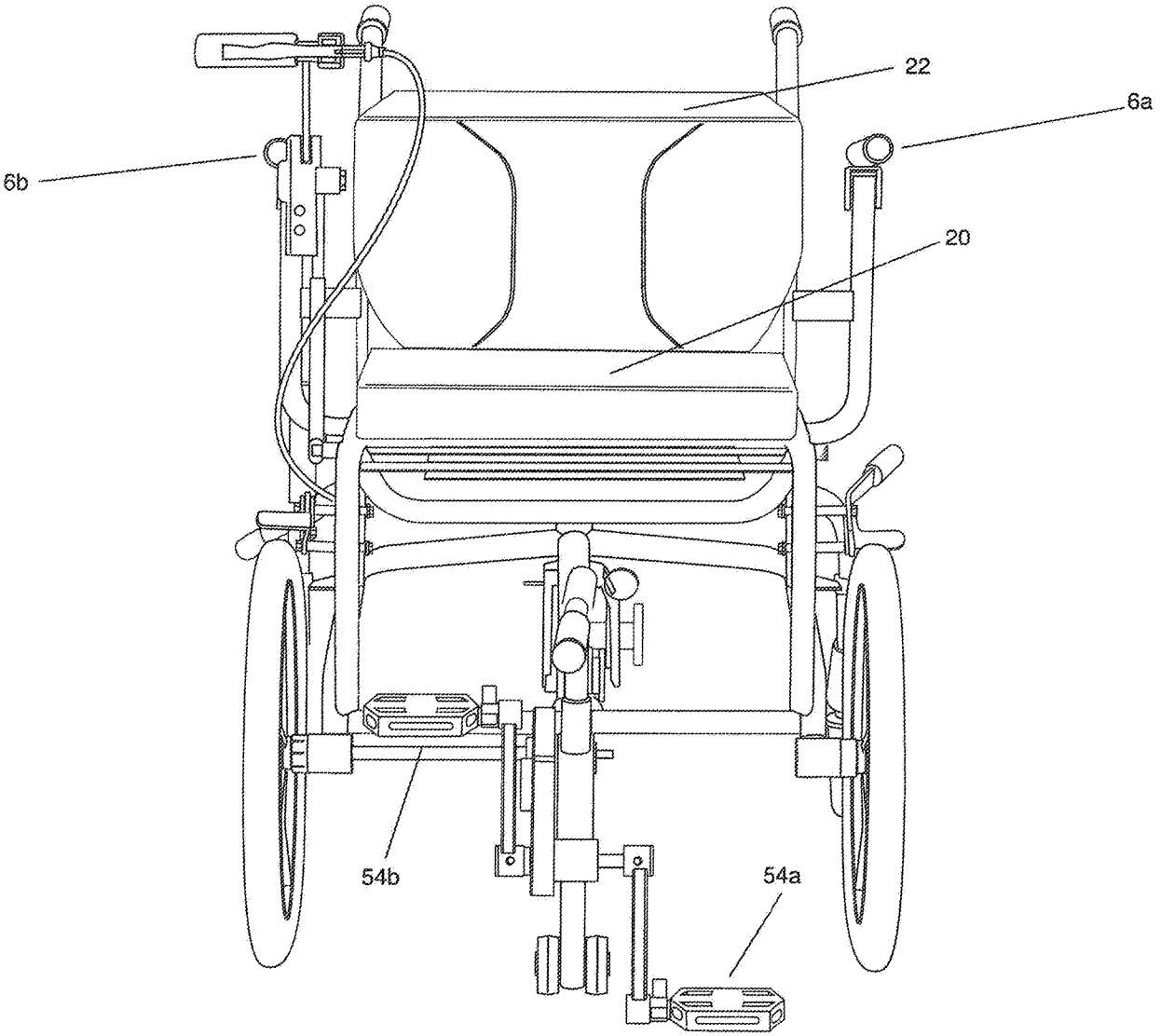
FIG. 4 is a front view of a convertible mobile exerciser of the disclosed technology.
Figure 5:
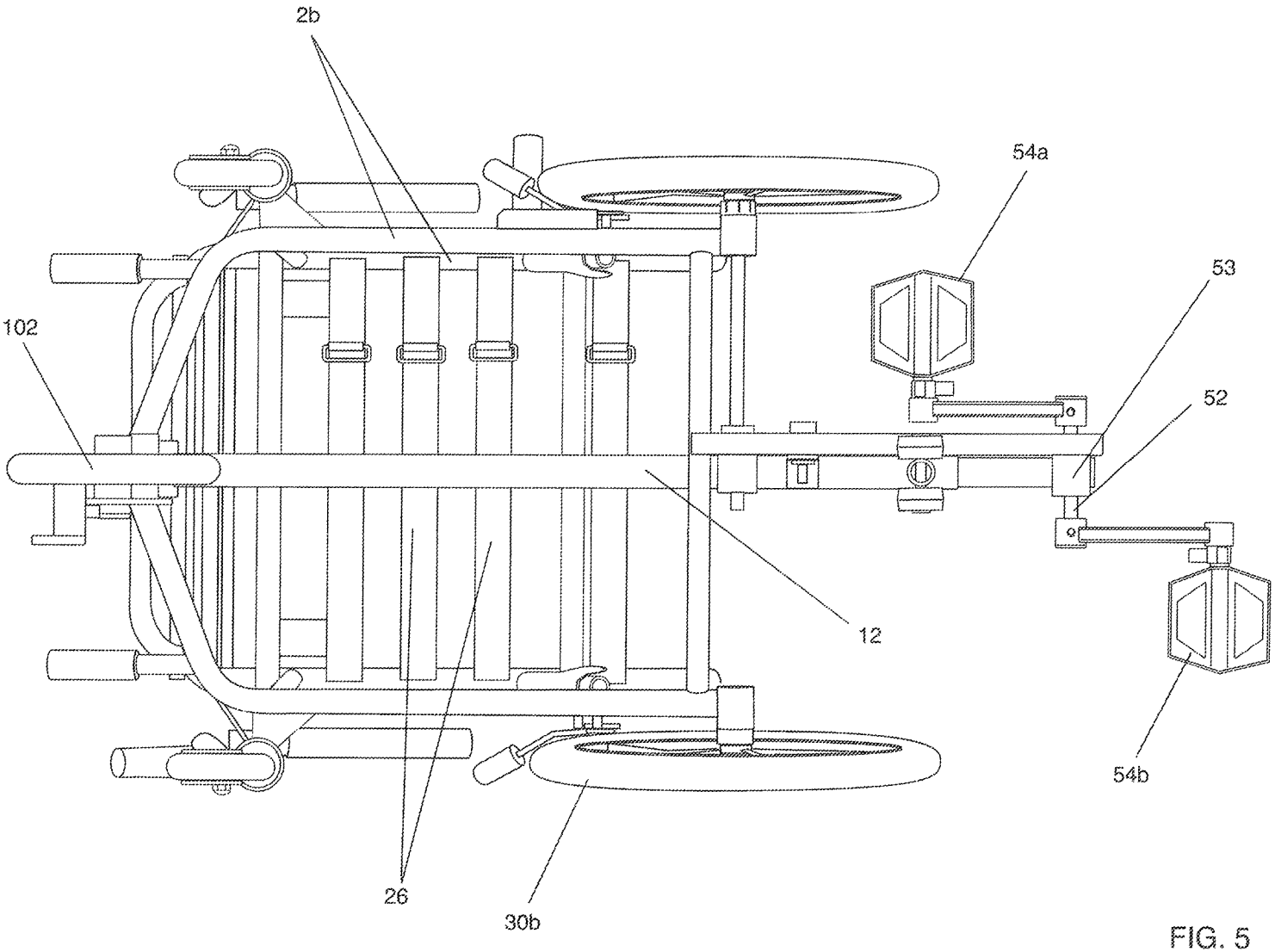
FIG. 5 is a bottom view of a convertible mobile exerciser of the disclosed technology.
Figure 6:
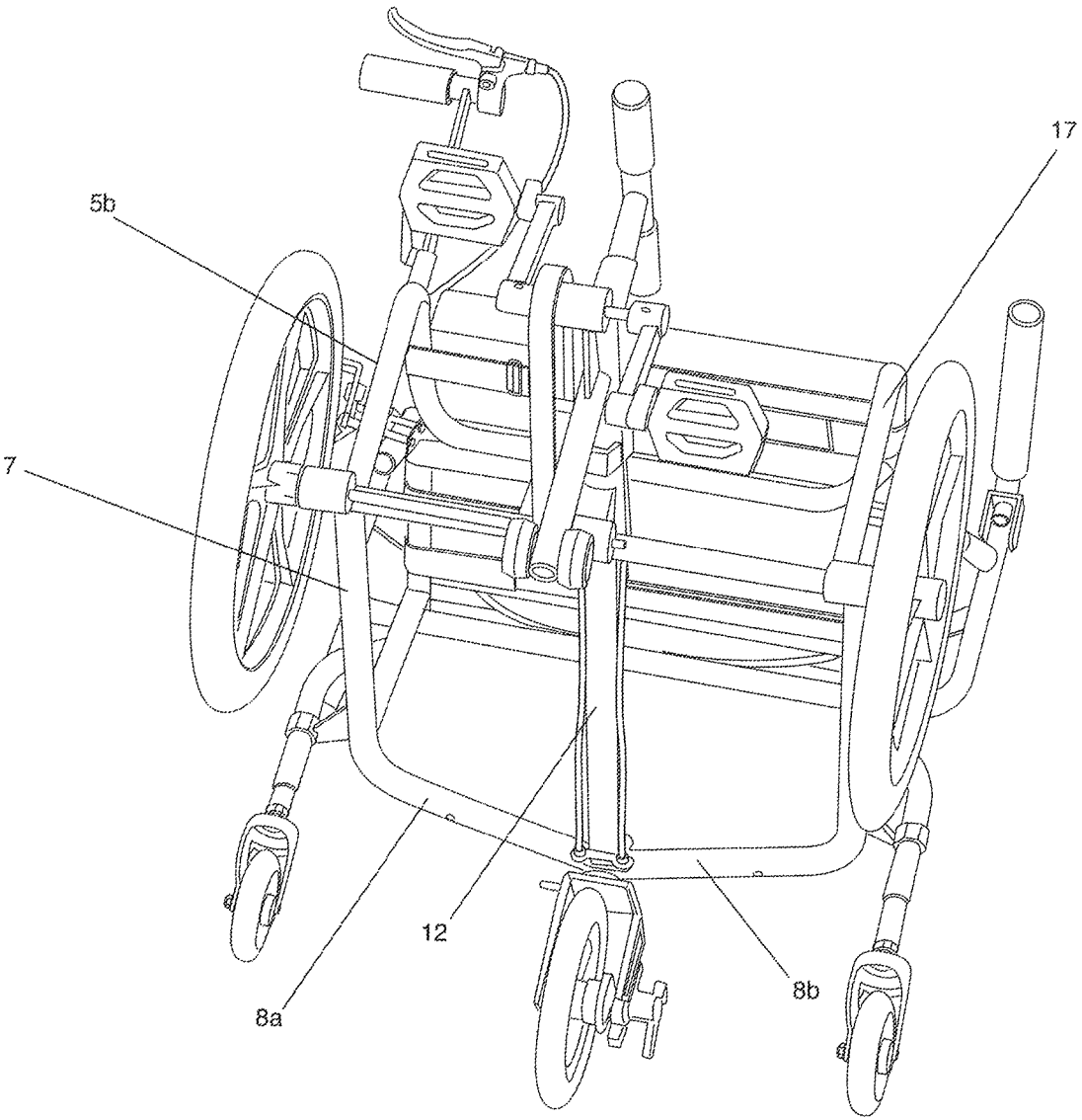
FIG. 6 is a bottom perspective view of a convertible mobile exerciser of the disclosed technology.

This specification describes technologies relating to a convertible mobile exerciser. FIGS. 1-22 show a rehabilitation mobile exerciser 1 of the disclosed technology. In some implementations, the rehabilitation mobile exerciser can be used in one of two modes. The first mode is a pedal mode that allows a user to pedal the mobile exerciser and build strength in the user's legs for rehabilitation purposes. The second mode is a push mode so that a user, when done exercising, can be pushed in the mobile exerciser by a second person.

In the pedal mode, a patient can pedal the mobile exerciser, either forward or in reverse, through the use of their legs and steer the mobile exerciser using a lever control controlled by their hand. The lever control operates the left and right direction of a rear wheel as well as having a brake to slow the speed of the mobile exerciser. When the pedal function is not in use, the mobile exerciser can be converted in a transporter. That is, the pedals can be removed, a foot support can be opened and tension can be removed from a crank assembly so that a user can rest his feet on the foot support and be pushed in a safe manner by a second person.

As shown in FIGS. 1-6, the mobile exerciser 1 can include a frame 2. In some implementations, the frame 2 can include (1) vertical bars 14*a*, 14*b* and crossbar 11 for forming an arm rest structure and (2) horizontal bars. 6*a*, 6*b*, vertical bars 3*a*, 3*b*, horizontal bars 4*a*, 4*b*, vertical bars 5*a*, 5*b*, vertical bars 16*a*, 16*b*, bent vertical bars 9*a*, 9*b*, crossbar 7, crossbar 17, crossbars 8*a*, 8*b*, horizontal bar 9 forming a seat structure. The arm rest structure can be structurally connected to the seat structure with brackets 23*a-b*. Please note the above supports can also form other parts of the mobile exerciser frame and can be connected to various assemblies as will be described more fully below. In some implementations, some of the frame supports can be welded to one another while other supports can be formed from a single piece of frame tubing.

The seat structure can be attached to a bottom cushion 20 and a back rest cushion 22 to provide a comfortable seating position for a user. The bottom cushion 20 and the back rest cushion 22 can be removable providing for easier maintenance of the seat. In some implementations, the bottom cushion 20 can rest on a set of tensioning belts 26 that can be tighten or loosen depending on user preference. These tensioning belts 26 can be secured to horizontal bars 4*a*, 4*b*.

Figure 7:
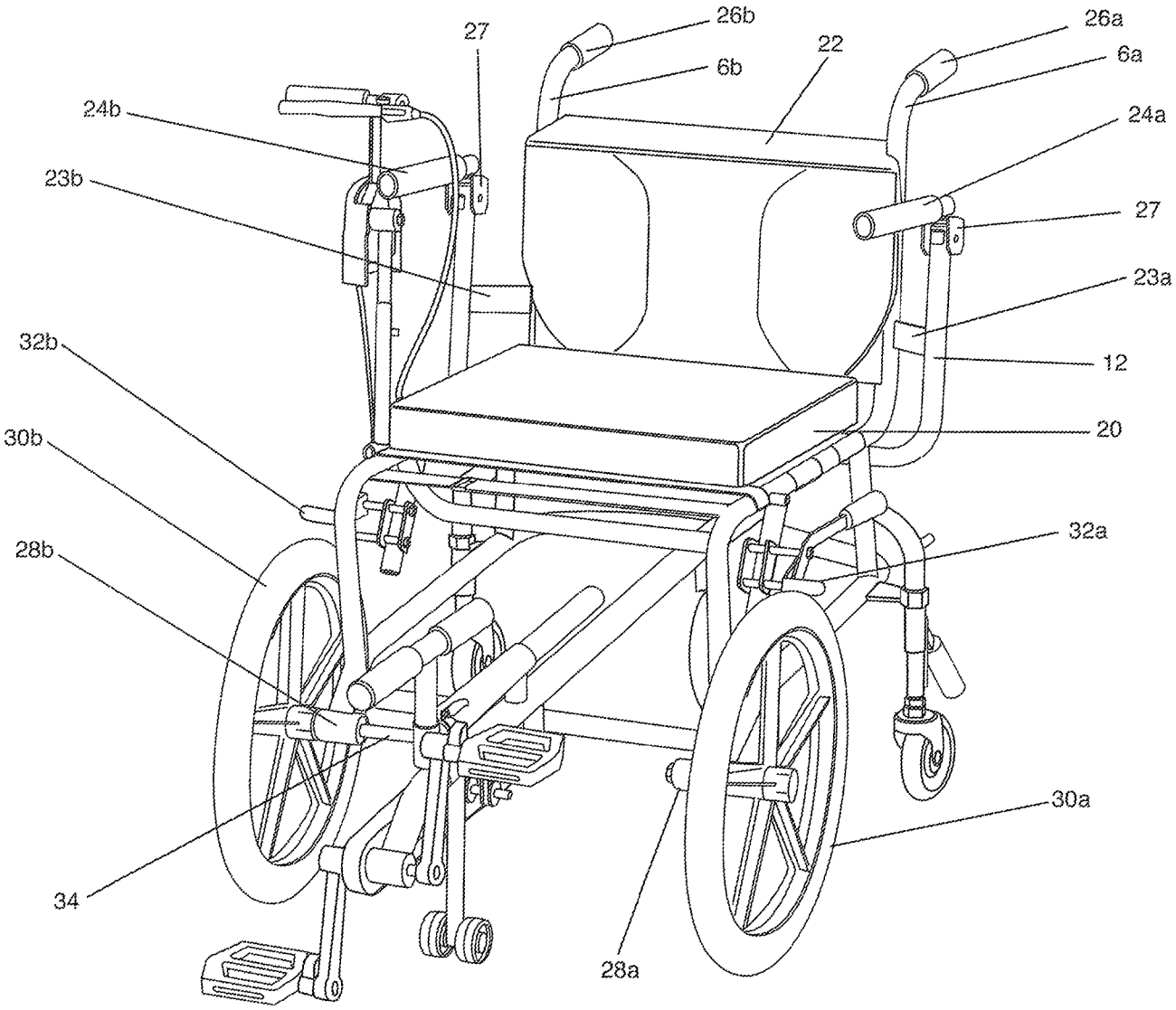
FIG. 7 is a top perspective view of a convertible mobile exerciser of the disclosed technology.
Figure 8:
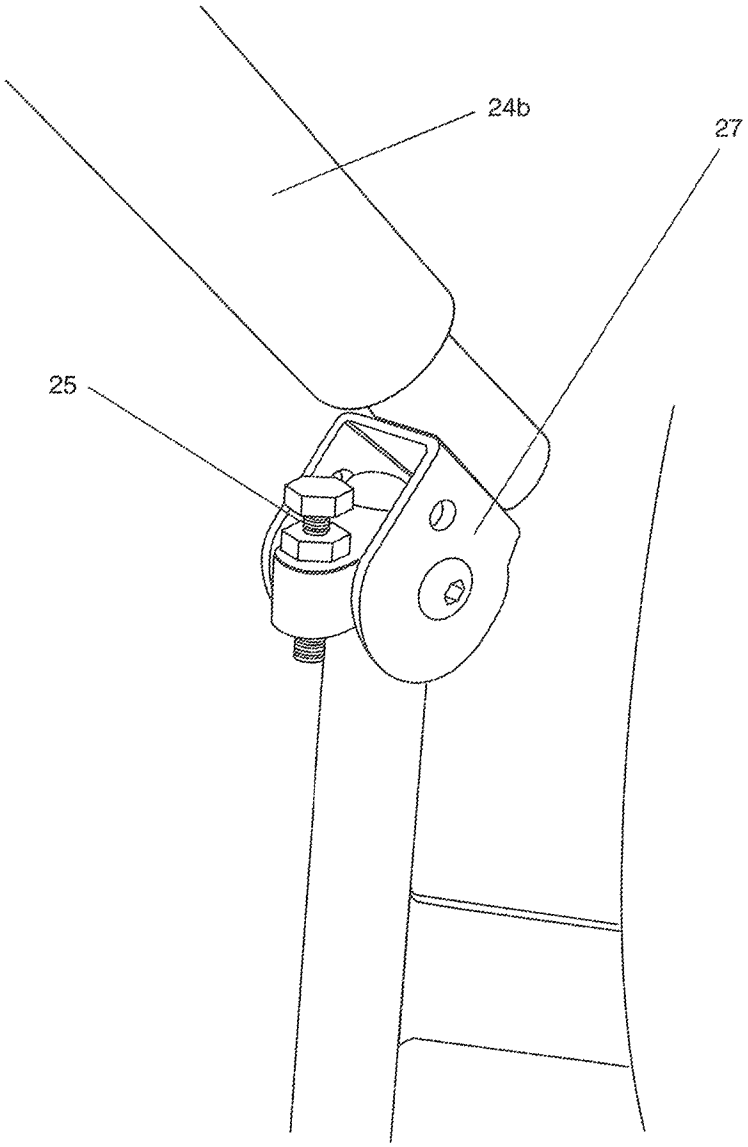
FIG. 8 is a close-up view of arm rest in an upright position of a convertible mobile exerciser of the disclosed technology.
Figure 9:
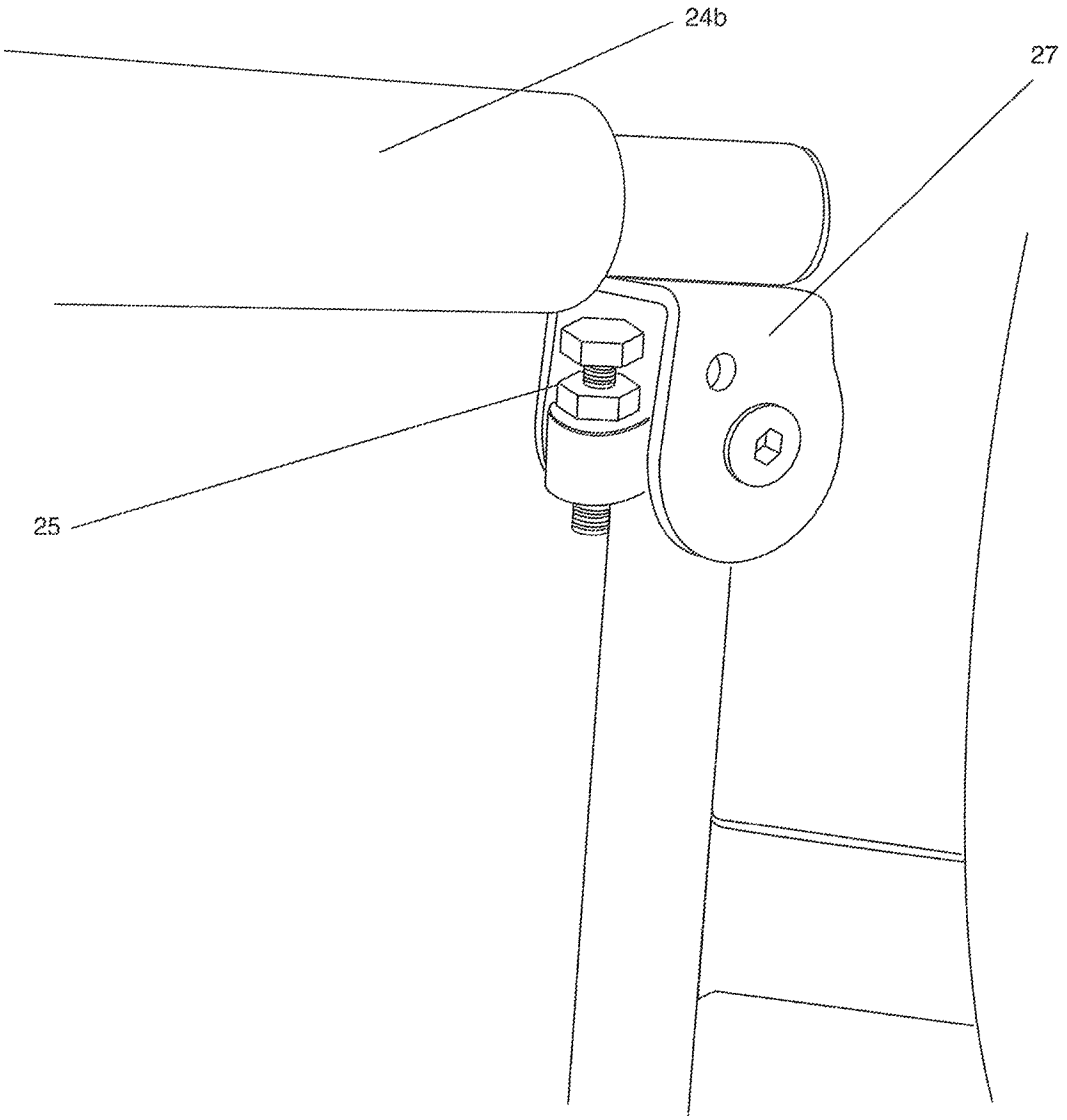
FIG. 9 is a close-up view of arm rest in a horizontal position of a convertible mobile exerciser of the disclosed technology.

As shown in FIGS. 7-9, the arm rest structure can be attached to arm rests 24*a-b*. These arm rest 24*a-b* can be hingedly or fixedly connected to the mobile exerciser frame. The arm rest 24*a-b* can be padded for comfort. In some implementations, the arm rest 24*a-b* can be hinged to the arm rest structure with hinge 27 and have a screw mechanism 25 for allowing a lift angle of the arm rests to be adjusted up or done when in a horizontal position, as shown in FIG. 9. If not needed, the arm rest can be moved to an upright position, as shown in FIG. 8.

As shown in FIG. 7, the frame 2 can also include handles 26*a-b* that are incorporated into the frame with horizontal bars 6*a-b*. The handles 26*a-b* can include hand grips for pushing the mobile exerciser 1 in an ergonomic fashion.

Figure 10:
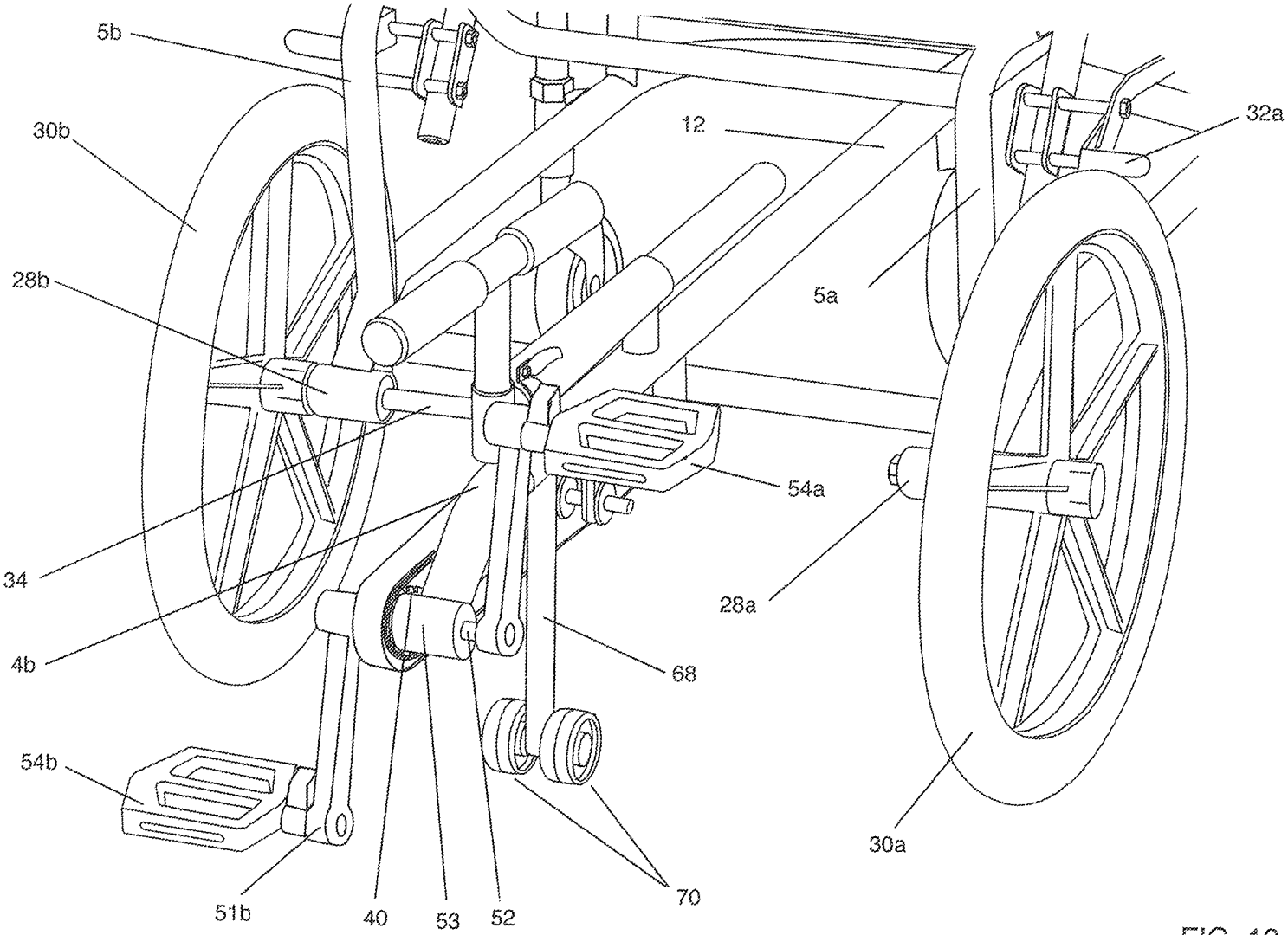
FIG. 10 is a close-up view of a pedal assembly of a convertible mobile exerciser of the disclosed technology.

As shown in FIG. 10, the vertical bars 5*a-b* of the frame 2 can be attached to front wheel hubs 28*a-b*. These hubs 28*a-b* can be used to attach front wheels 30*a-b*,respectively. The front wheels 30*a-b* can be 16 to 26 inches in diameter but other sizes are contemplated. Wheel 30*a* is capable of freely rotating about an axis while the wheel 30*b* can be attached to an axle 34 that can be switched between a freely rotating mode and a pedal mode. In some implementations, the tire orientations can be switched. Further, in some implementations, manual locks 32*a-b* can be mounted to the frame so as to immobilize the front wheels 30*a-b* of the mobile exerciser 1, e.g., when loading or unloading a user onto the seat of the mobile exerciser.

Figure 11:
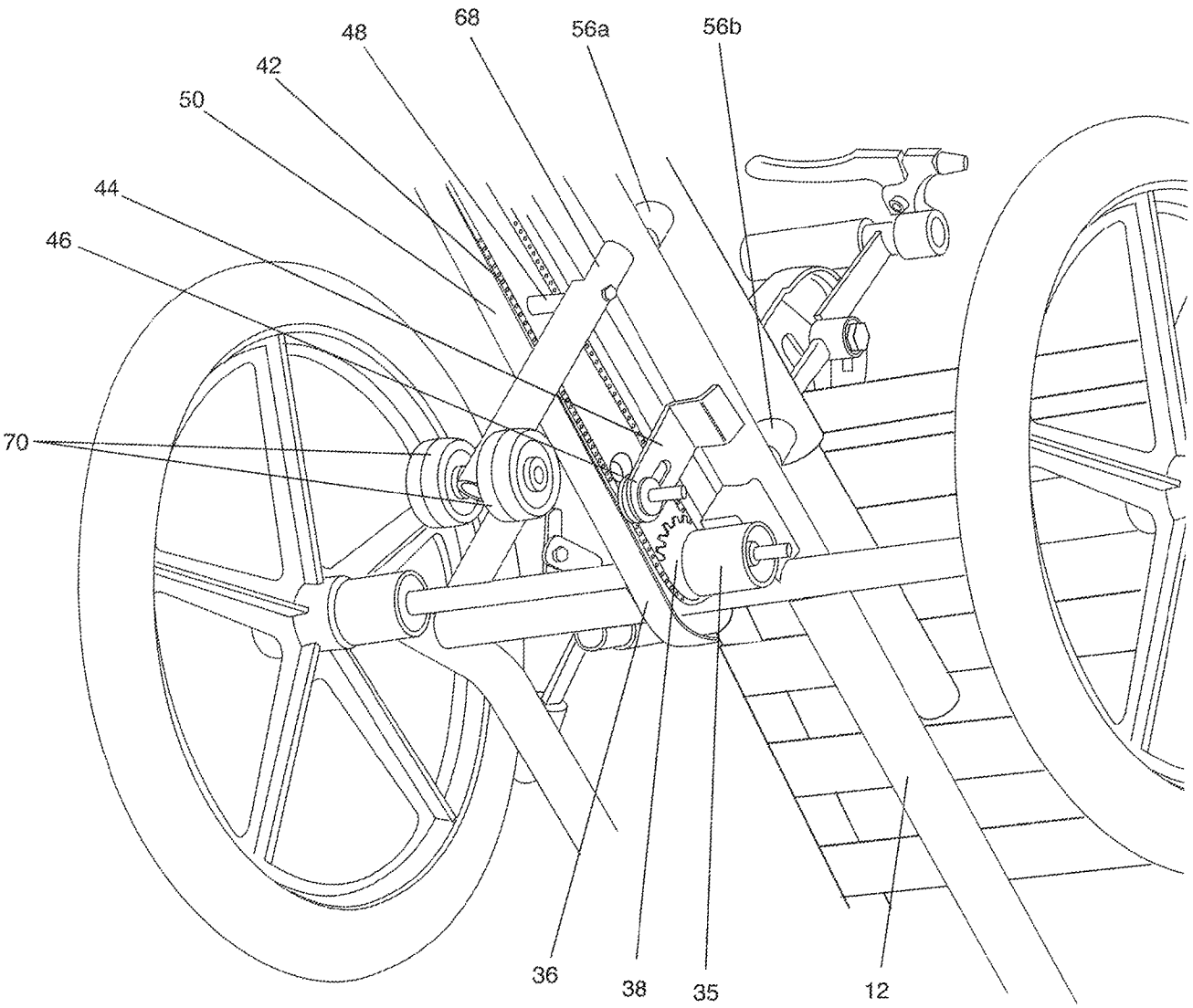
FIG. 11 is a close-up view of a pedal assembly of a convertible mobile exerciser of the disclosed technology.

As shown in FIG. 11, the axle 34 attached to wheel 30*b* can be communicatively attached to a crank assembly 36 via an axle sprocket 38. That is, the axle sprocket 38 can be communicatively connected to a front sprocket 40 with a chain 42. The frame 2 can include a chain tensioning support 44 for mounting a chain tensioner 46. This chain tensioner 46 can used to tighten or loosen the chain 42 as needed for operation. The chain tensioner 46 can also remove all tension from the chain 42 when the mobile exerciser 1 is converted into push mode and reapply tension when converted to pedal mode. The frame 2 can also include a support 48 for attaching a chain protector 50 so that the chain 42 does not come into contact with the user or catch onto a user's clothing during operation.

Figure 15:
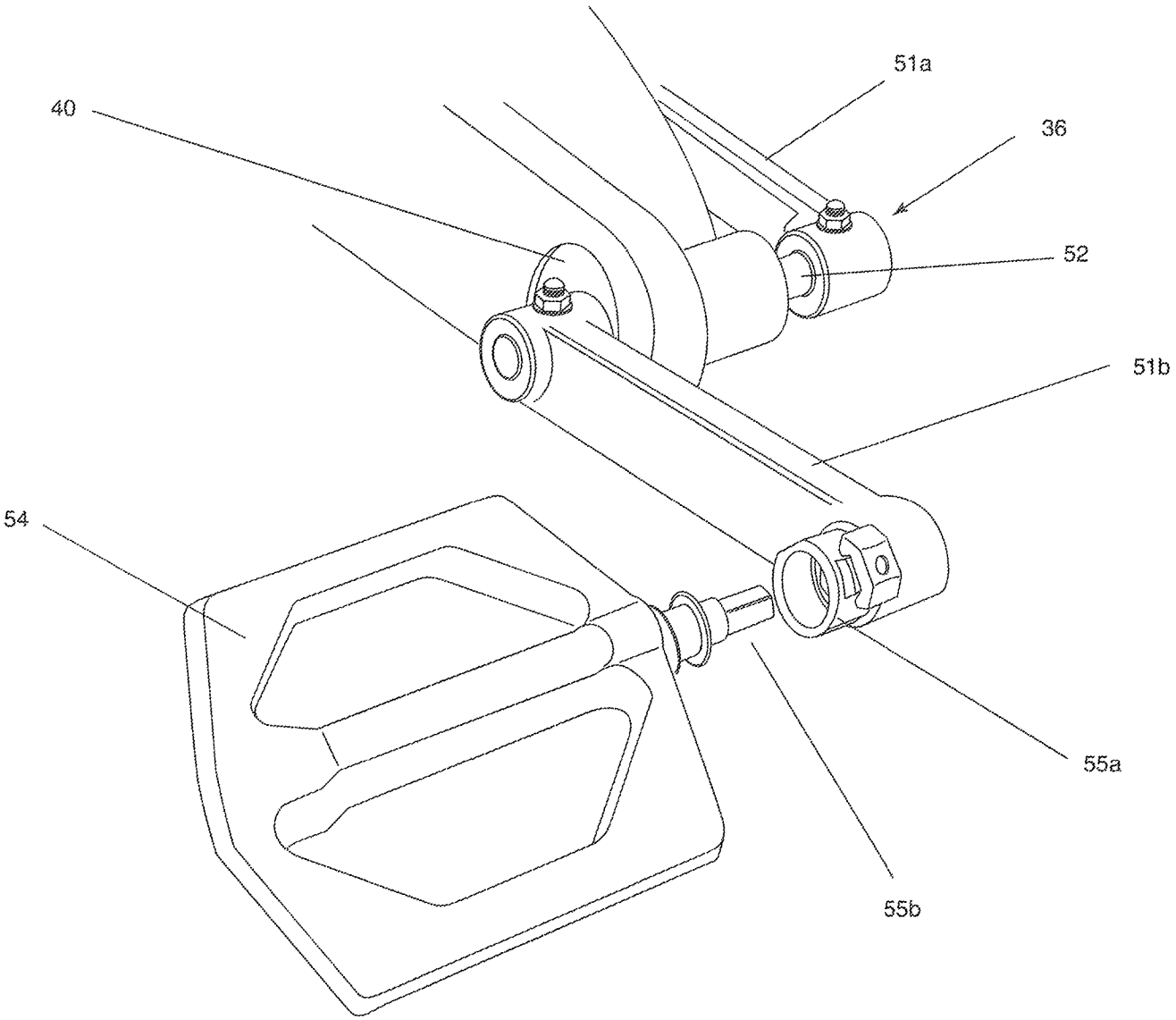
FIG. 15 is a close-up view of a pedal of a convertible mobile exerciser of the disclosed technology.

The front sprocket 40 of the crank assembly 36 can be connected to a spindle 52 housed in a hub 53. The spindle 52 can be connected to crank arms 51*a-b* at one end and the crank arms 51*a-b* can be connected to the pedals 54*a-b* at the other end. In some implementations, as shown in FIG. 15, the pedals 54 can have a quick release 55*a-b* for removal of the pedals 54 when converting to push mode or vice versa.

As shown in FIG. 10, the spindle 52 can pass through the hub 53. The hub 53 is connected to a front end of horizontal support 12 on the frame 2. The horizontal support 12 extends from the hub 53 to a rear end of the mobile exerciser 1. At the back end of the horizontal support 12 is a rear wheel hub 100 which will be described in more detail below. Between the front end and the back end of the horizontal support 12 is an axle hub 35 for housing one end of the axle 34. The axle hub 35 is fixedly attached to the horizontal support 12.

Figure 12:
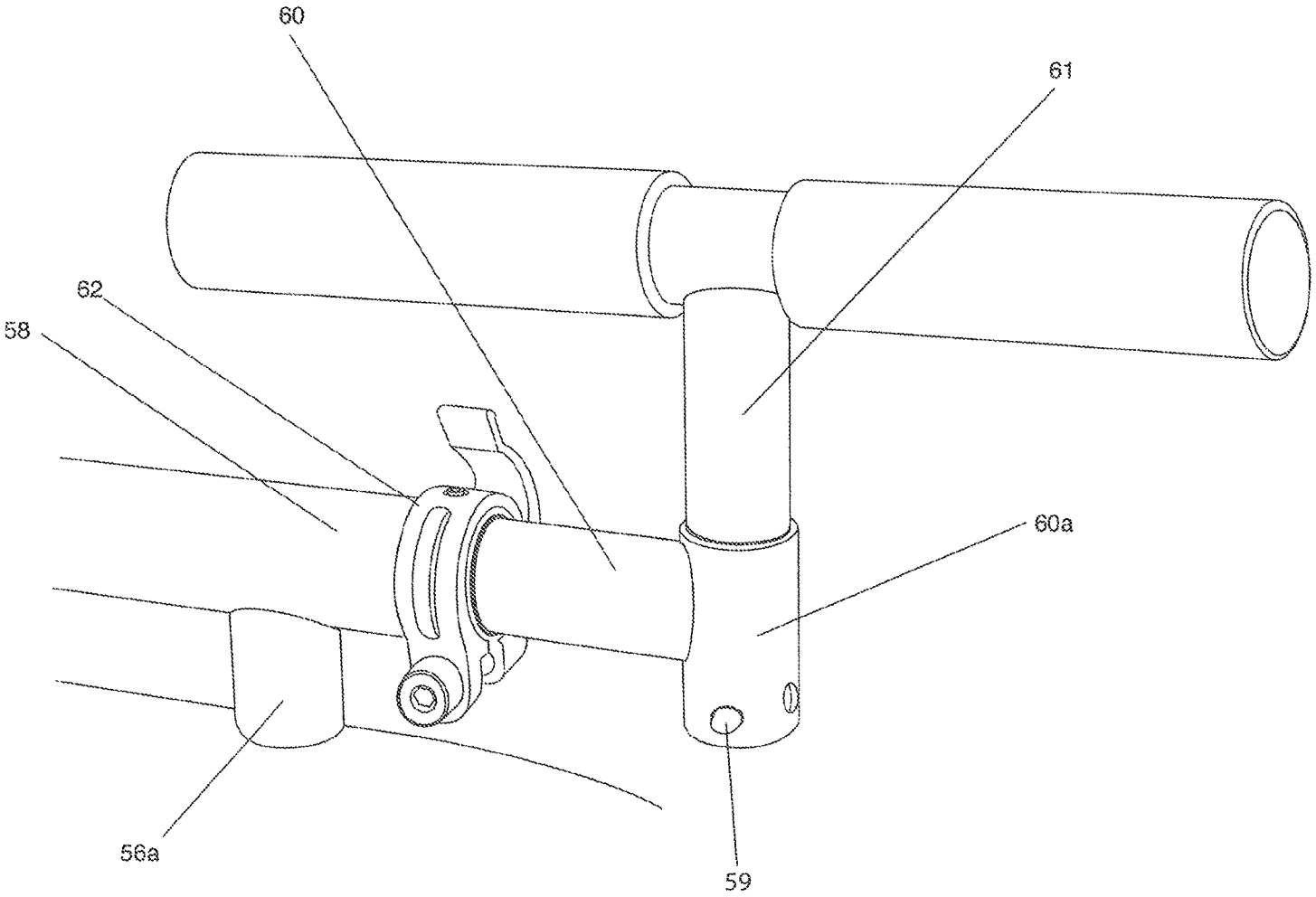
FIG. 12 is a close-up view of a foot rest assembly of a convertible mobile exerciser of the disclosed technology in a stored position.
Figure 13:
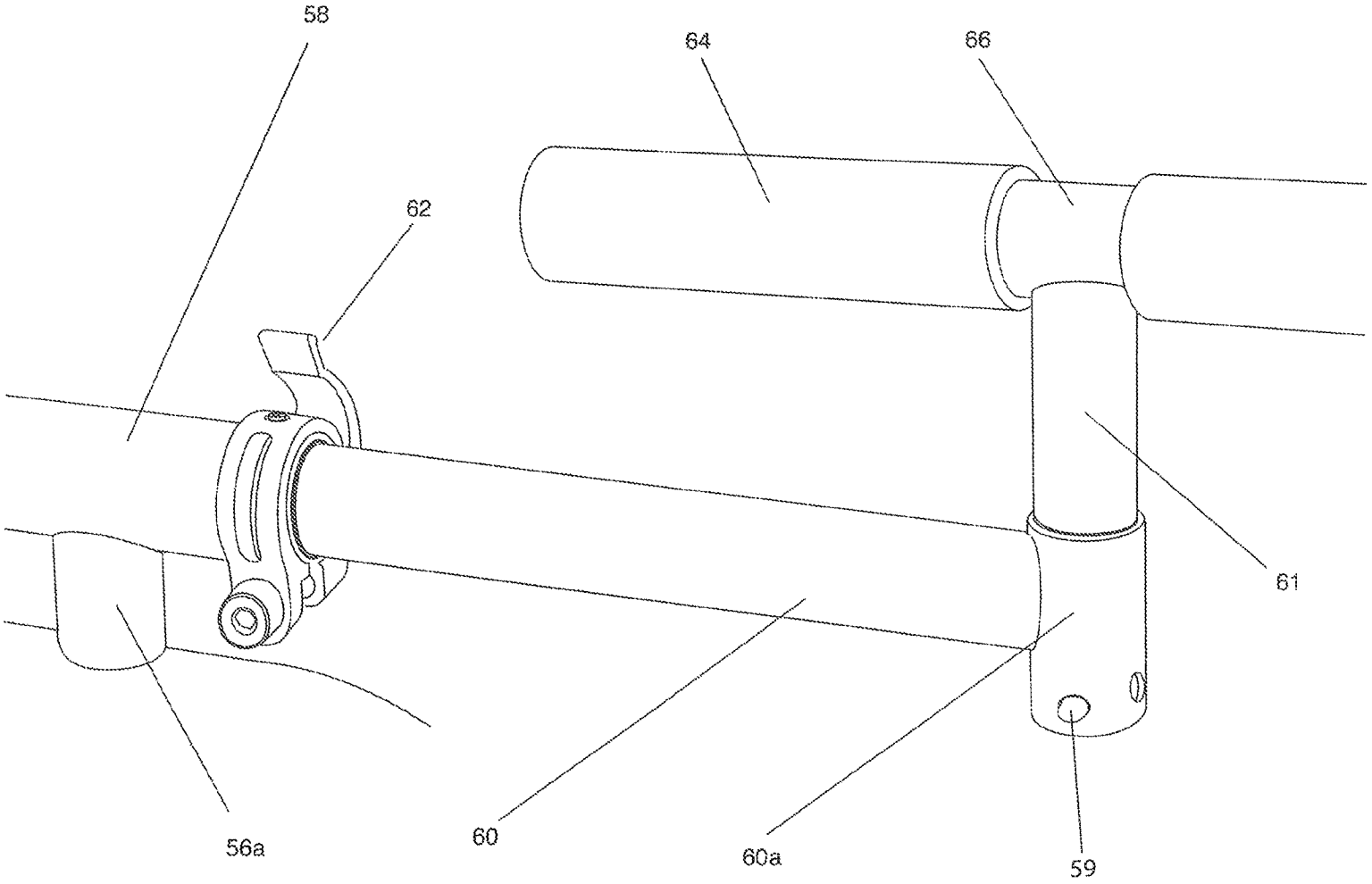
FIG. 13 is a close-up view of a foot rest assembly of a convertible mobile exerciser of the disclosed technology in a partially opened position.
Figure 14:
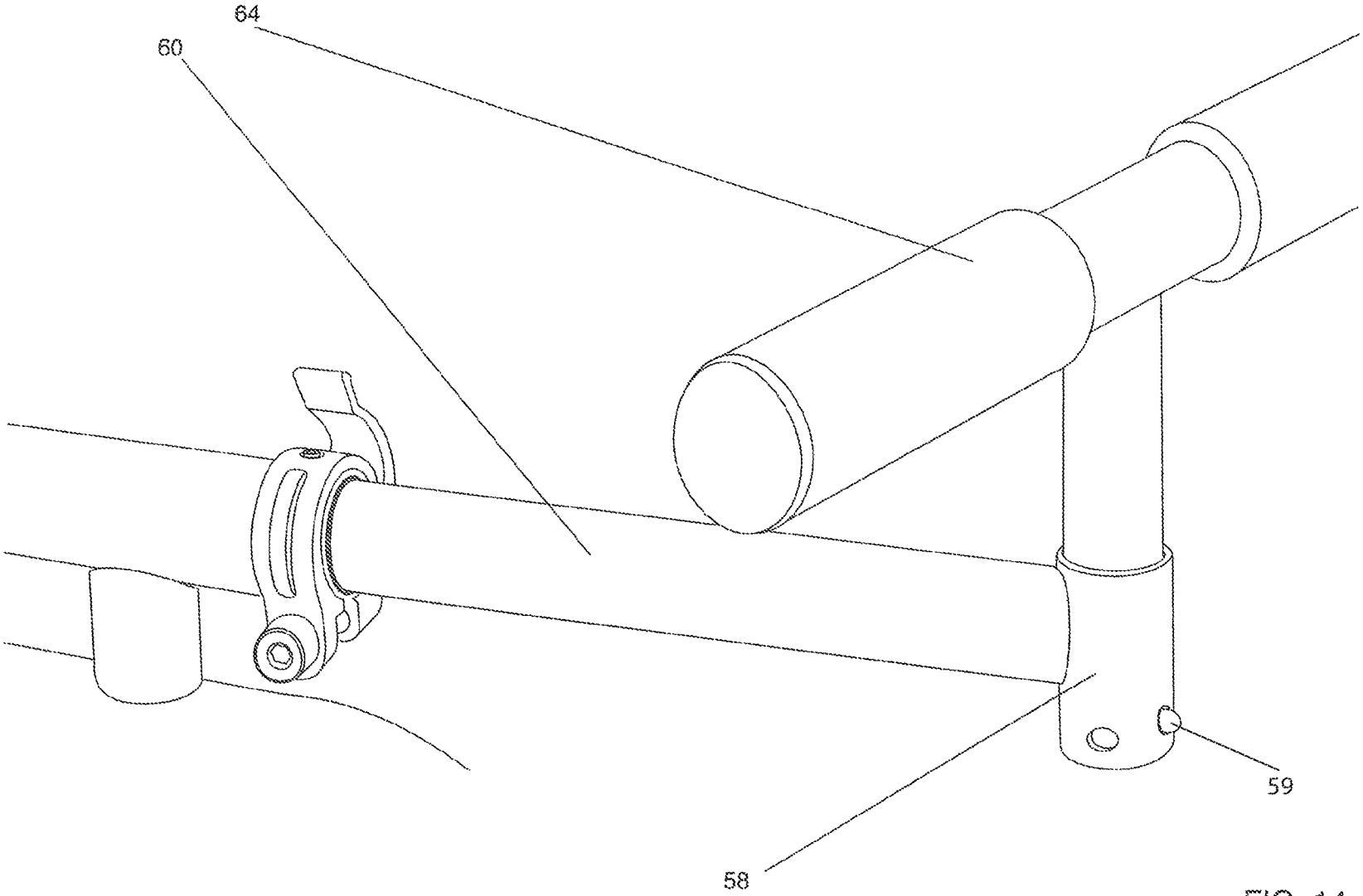
FIG. 14 is a close-up view of a foot rest assembly of a convertible mobile exerciser of the disclosed technology in a working position.

Also attached to the horizontal support 12 are mounts 56*a-b*. The mounts 56*a-b* can be attached to a hollow tubing 58. As shown in FIGS. 12-14, the hollow tubing 58 is capable of slidingly receiving a foot rest extension rod 60. The foot rest extension rod 60 is capable of telescoping from the hollow tubing 58 so that the foot rest can be moved from a working position or a stored position as shown in FIGS. 1 and 2. Clamp 62 can be used to secure the rod 60 when in its working or stored position. The working end of the foot rest extension rod 60 is attached to a second hollow tube 60*a* for receiving a foot rest rod 61. The foot rest rod 61 if capable of rotating within the hollow tubing 60*a* to put a foot rest 64 into a working or stored position. The foot rest 64 can be a rod 66 having a left and right side with a non-slip material for supporting the feet of a user when the mobile exerciser is converted into a transporter but other foot rest are contemplated. The foot rest also has a stored position when the mobile exerciser is in pedal mode. In some implementations, the foot rest can move from the working position to a rest position using a push button mechanism 59.

The frame 2 also has a front stabilizer support 68 mounted to the horizontal support 12 on a first end. This front stabilizer support has wheels 70 attached to the second end. These wheels 70 give the mobile exerciser 1 added stabilization.

Figure 16:
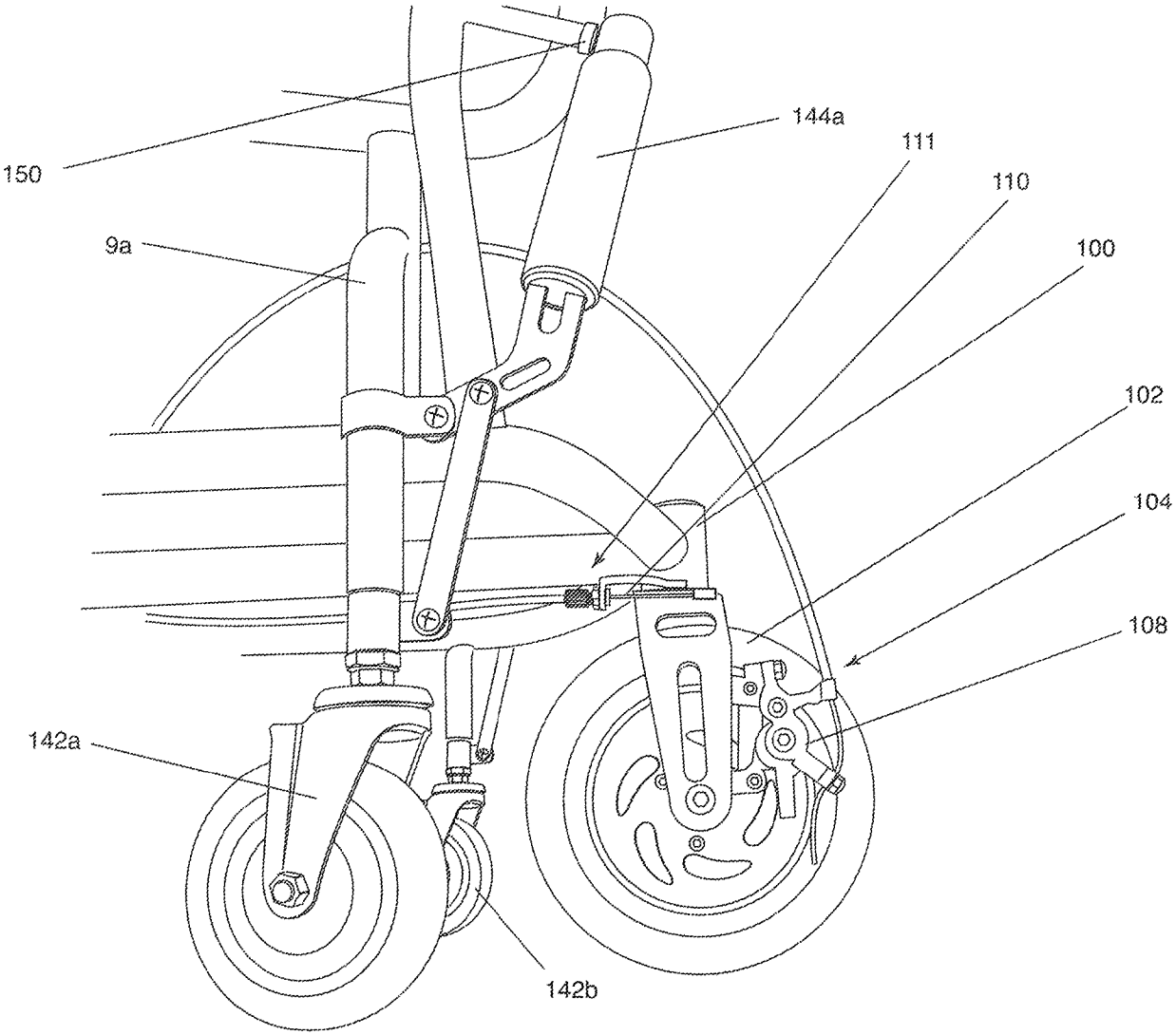
FIG. 16 is a close-up view of a rear wheel of a convertible mobile exerciser of the disclosed technology.
Figure 22:
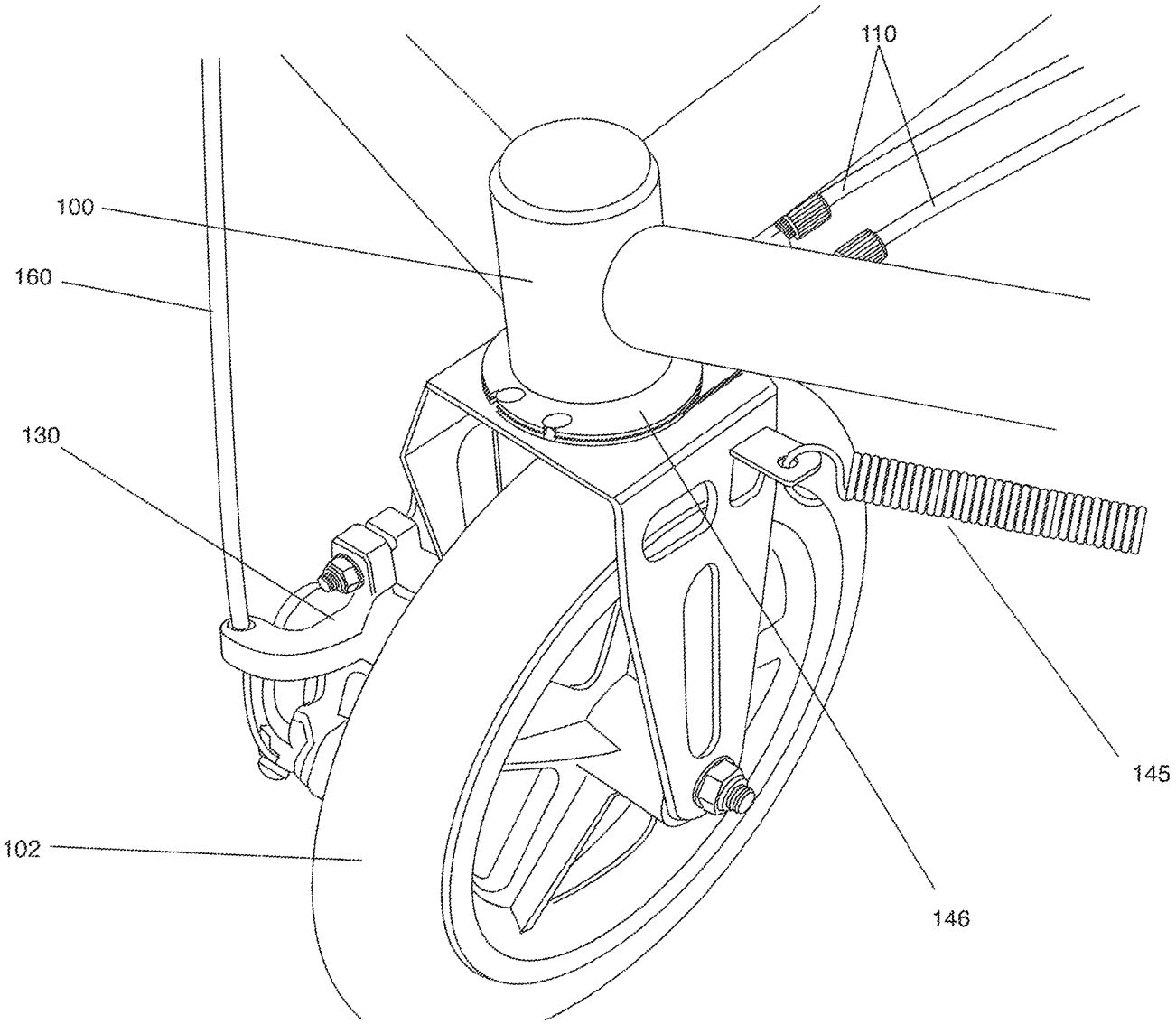
FIG. 22 is a close-up view of a rear wheel of a convertible mobile exerciser of the disclosed technology.

As shown in FIGS. 16 and 22, the rear wheel hub 100 is used to attach a rear wheel 102 to the frame 2. The rear wheel 102 can be a swivel wheel that can rotate freely or rotate when acted upon by a steering assembly 104 for controlling a direction of the rear wheel 102, as will be described more fully below. The rear wheel 102 can also have a brake assembly 106 for applying a brake 108 to the rear wheel 102, as will be described more fully below.

Figure 17:
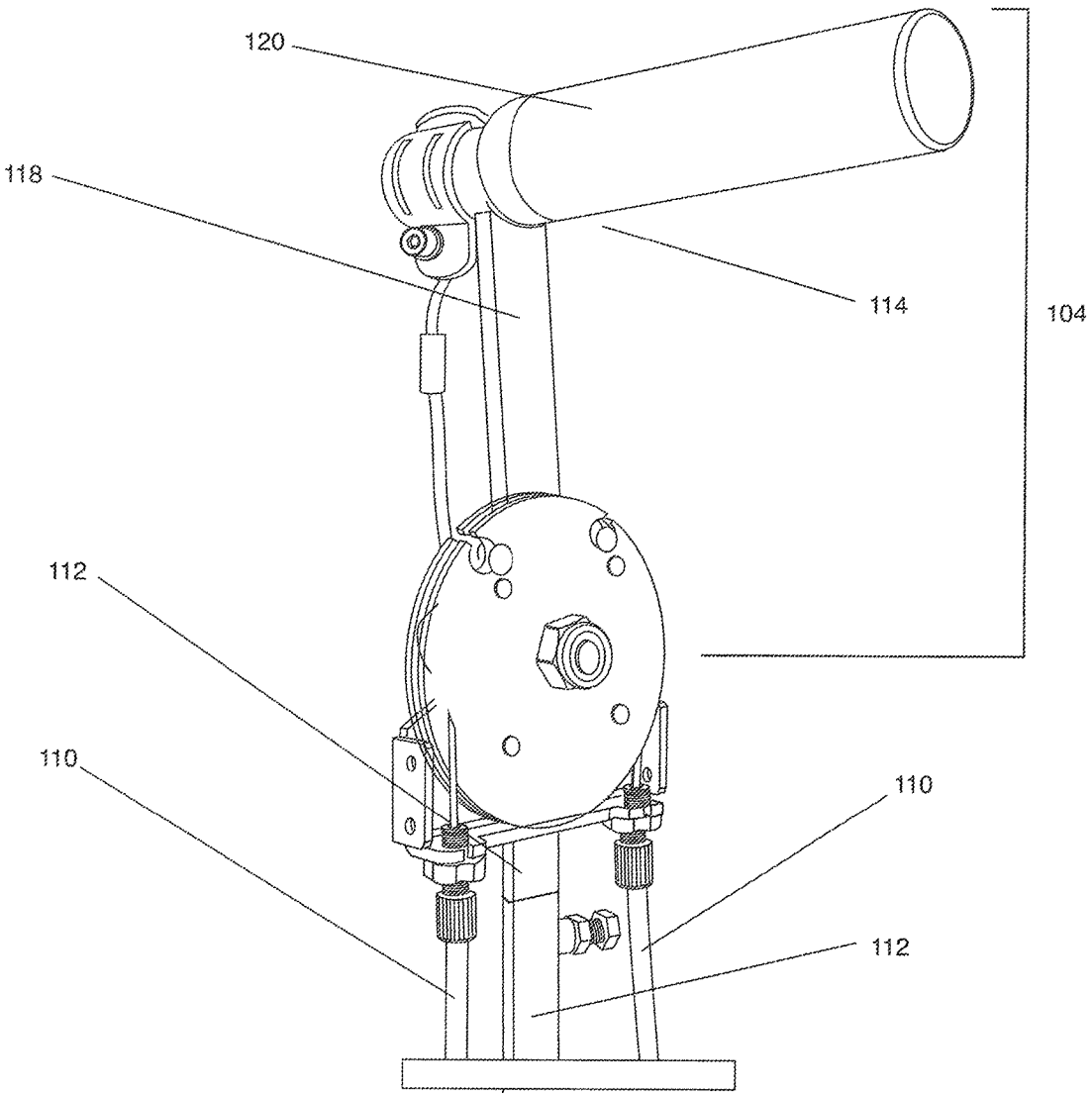
FIG. 17 is a close-up view of a unattached steering assembly of a convertible mobile exerciser of the disclosed technology.
Figure 18:
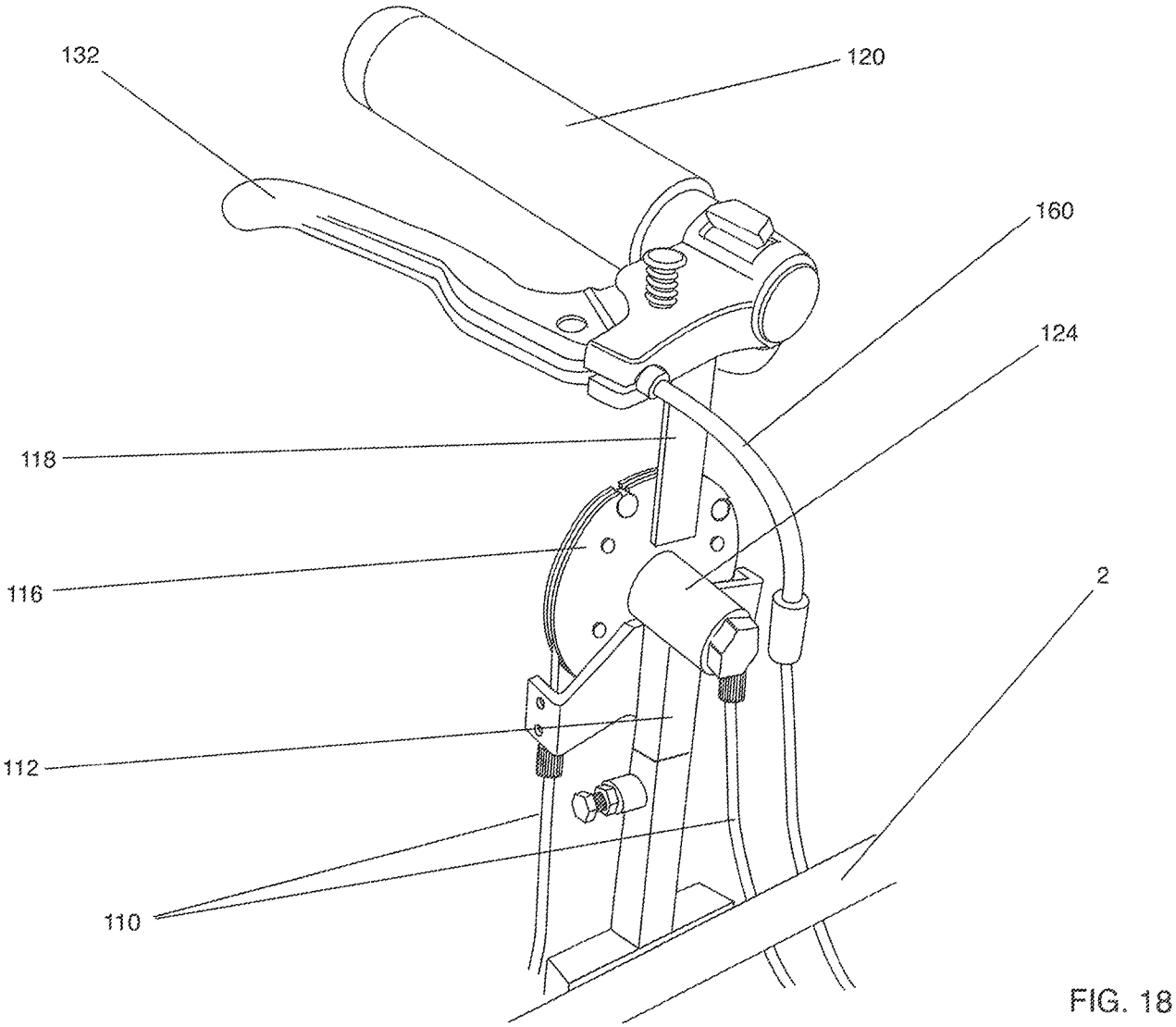
FIG. 18 is a close-up view of an attached steering assembly of a convertible mobile exerciser of the disclosed technology.
Figure 19:
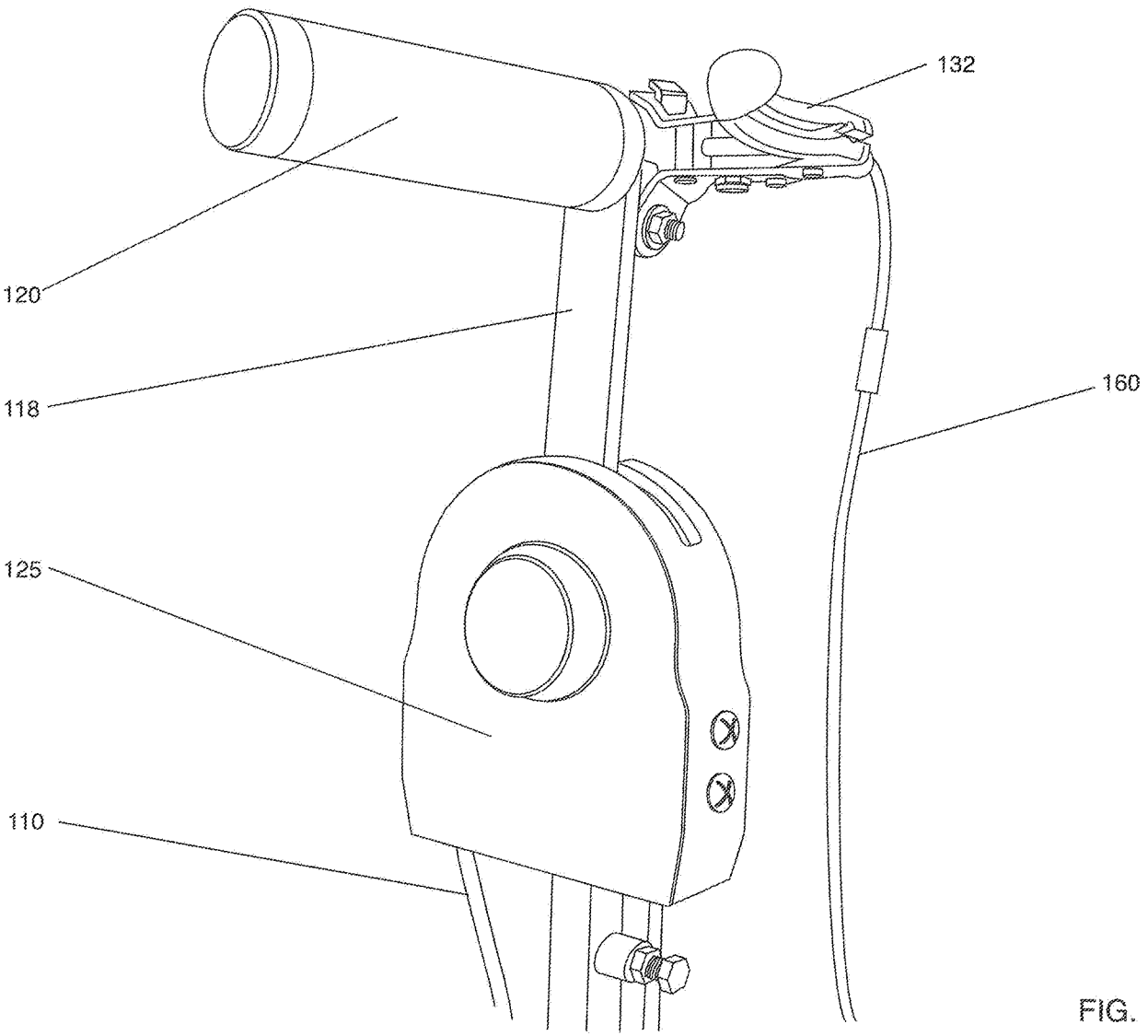
FIG. 19 is a close-up view of an attached steering assembly with a protective cover of a convertible mobile exerciser of the disclosed technology.
Figure 20:
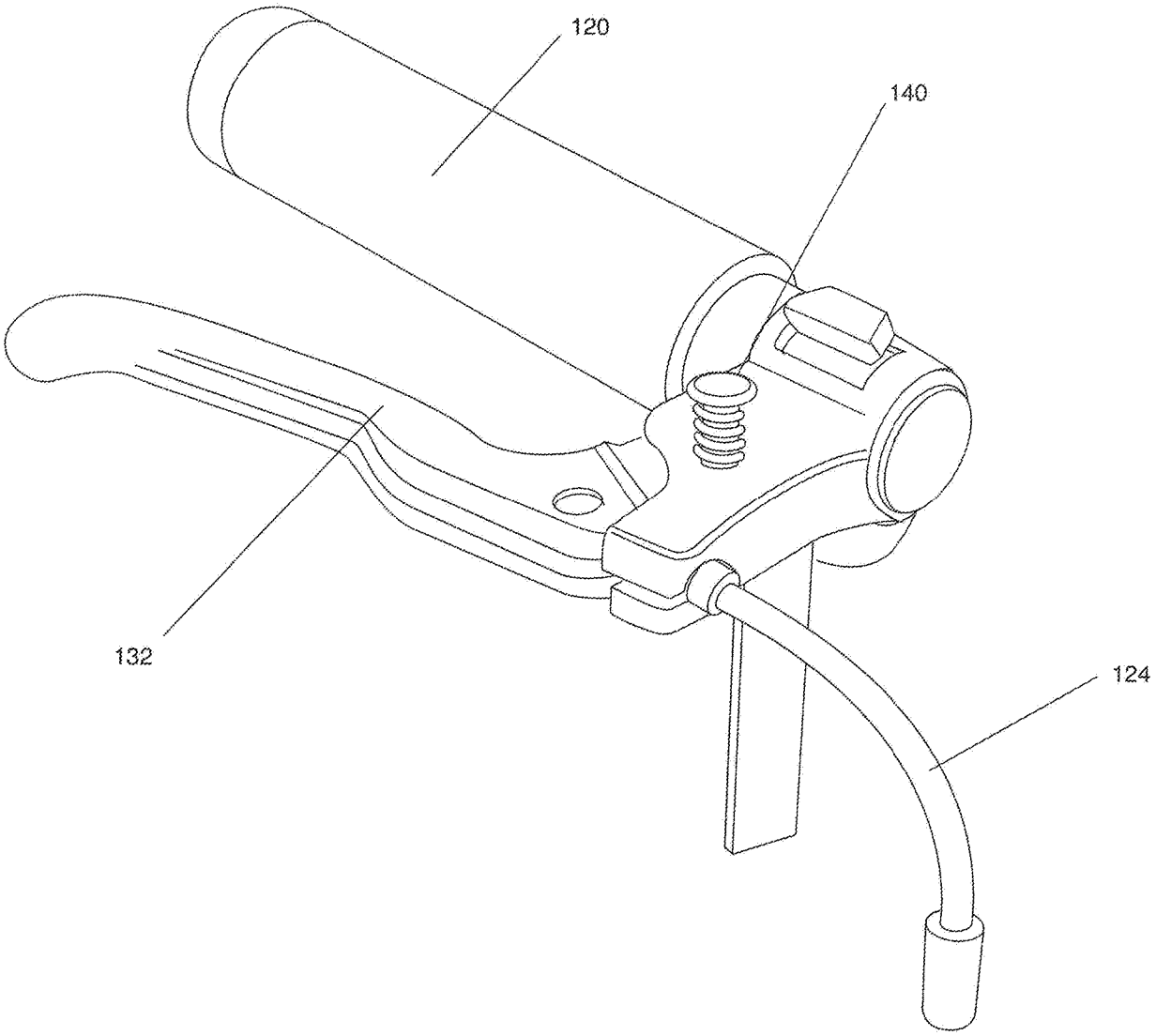
FIG. 20 is a close-up view of brake lever of a convertible mobile exerciser of the disclosed technology.
Figure 21:
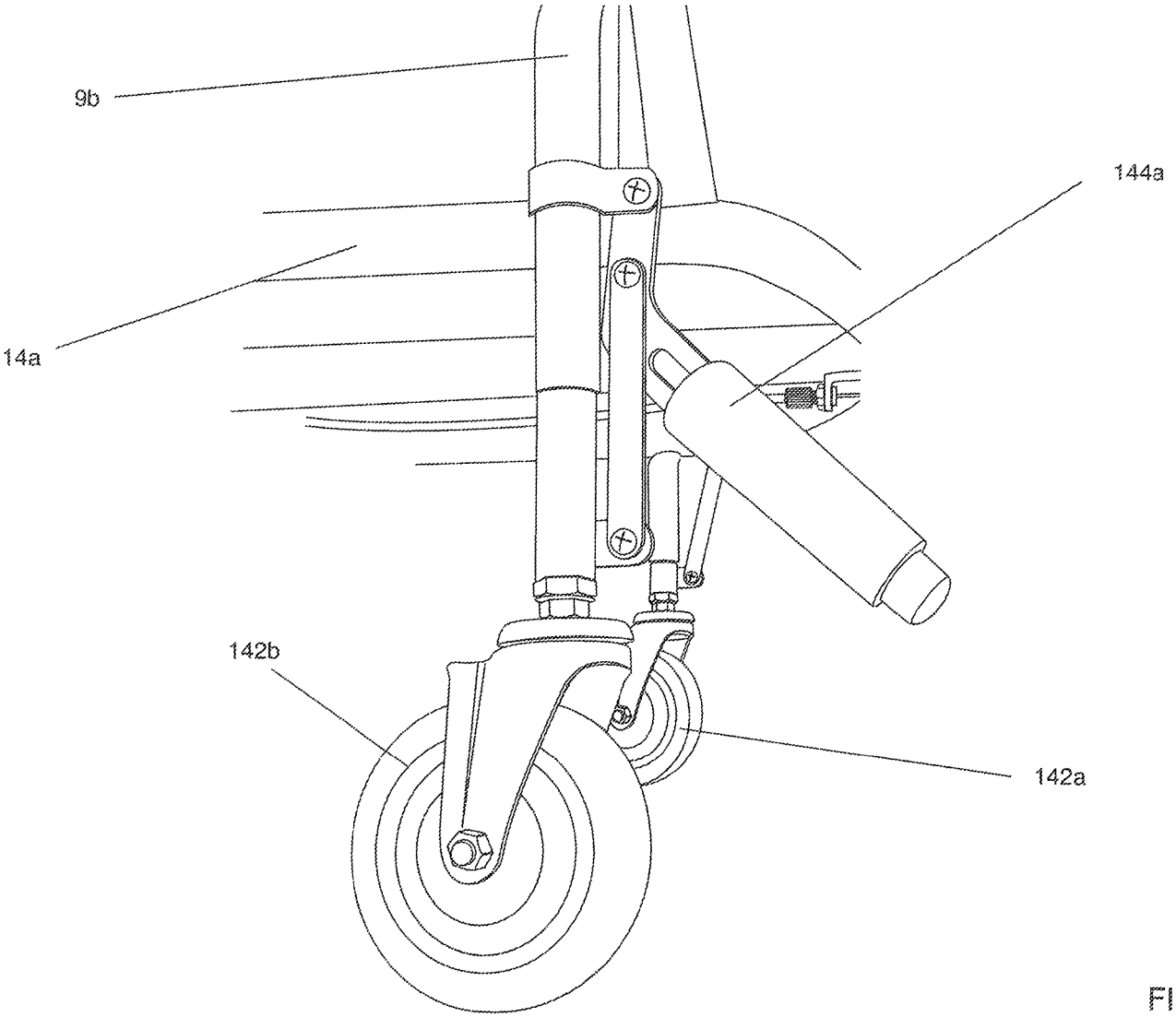
FIG. 21 is a close-up view of auxiliary wheels of a convertible mobile exerciser of the disclosed technology.

As shown in FIG. 17, the steering assembly 104 can include a set of cables 110, a steering shaft 112 and steering controls 114. As shown in FIG. 18, the steering shaft 112 can be mounted to the frame 2 at a first end adjacent the bottom seat and extends upwards. The steering shaft 112 can be mounted so that a user's hand can reach the shaft 112 controls when seated in the mobile exerciser 1 and can be mounted to the left side or right side depending on preference of a user, e.g., left-handed or right handed.

The second end of the steering shaft 112 supports the steering controls 114. The steering controls 114 include a cable actuator 116, a rod 118 and a handle 120. The cable actuator 116 can be a cable wheel 122 that transfers motion from the rod 118 to the steering cables 110. The rod 118 can be fixedly attached to the cable actuator 116 and the combination rod 118 and actuator 116 can be rotatably attached to a steering shaft mount 124 with a hinge 126. The cable wheel 122 can have a protective cover 125 attached to the steering shaft 112.

In use, when a user is pedaling the mobile exerciser and wants to tum, the user can move the handle 120 either forward or backwards. This motion allows the rod 118 to move the cable actuator 116 which in turn applies bias to the cables 110. The cables 110 are attached to a directional assembly 111 and controls the direction of the rear wheel 102. The directional assembly 111 also includes an actuator 146 and a spring 145 for serving as a centering device. When the mobile exerciser is in push mode, the user does not need to control direction as the rear wheel 102 spins freely and direction can be controlled by the person pushing the mobile exerciser.

The disc brake assembly 106 can include disc brakes 130, a hand lever 132 and a cable 160 communicatively connecting the disc brake 130 to the hand lever 132. The hand lever 132 can be mounted on the second end of the steering shaft 112 on the frame 2 near the steering control rod 118 and handle 120 and can be manipulated with the user's hands. The hand lever can also have a lock 140 so to immobilize the mobile exerciser when needed.

Bent vertical bars 9*a*, 9*b* of the frame 2 can be used to receive a set of auxiliary caster wheels 142*a-b*. The auxiliary caster wheels 142*a-b* are offset to provide better stability and are adjustable up or down through a use of levers 144*a-b* and magnets 150. That is, the wheels lock in a down position using an over center positioning of handles 144*a-b* and they are held in an up position with the use of a magnetic button 150. The auxiliary caster wheels 142*a-b* can swivel freely in a horizontal plane. The bent vertical bars 9*a*, 9*b* can be secured to vertical bars 16*a*, 16*b* with a bracket 144.

In some implementations, the frame 2 can also include supports for securing a motorized propulsion system (not shown).

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A mobile exerciser comprising:

a mobile exerciser frame;

a foot rest assembly attached to the mobile exerciser frame, the foot rest assembly having a working position and a stored position;

a pedal assembly attached to the mobile exerciser frame, the pedal assembly having a working position and a stored position; and a set of auxiliary wheels, the set of auxiliary wheels being adjustable between an up position and a down position with a lever, wherein the mobile exerciser is converted from a push mode to a pedal mode by moving the foot rest assembly into the stored position and the pedal assembly into the working position and the mobile exerciser is converted from the pedal mode to the push mode by moving the foot rest assembly into the working position and the pedal assembly into the stored position.

2. The mobile exerciser of claim 1 wherein the foot rest assembly further includes a hollow tube and an extension rod, the extension rod telescoping from the hollow tubing when converting the foot rest assembly from the stored position into the working position.

3. The mobile exerciser of claim 2 wherein the extension rod is secured with a clamp when the foot rest assembly is in the working position.

4. The mobile exerciser of claim 1 wherein the foot rest assembly farther includes a foot rest, the foot rest being twisted 90 degrees when converting the foot rest assembly from the stored position into the working position.

5. The mobile exerciser of claim 4 wherein the foot rest assembly is secured with push button mechanism.

6. The mobile exerciser of claim 1 wherein the pedal assembly further includes a crank shaft having pedals, the pedals being removed when converting the pedal assembly from the working position into the stored position.

7. The mobile exerciser of claim 1 wherein the pedal assembly further includes a crank shaft having a chain tensioner, the chain tensioner releasing tension on a chain when converting the pedal assembly from the working position into the stored position, the chain connecting the front sprocket to the axle sprocket.

8. The mobile exerciser of claim 1 further comprising: a steering assembly, the steering assembly controlling a direction of a rear wheel of the mobile exerciser.

9. The mobile exerciser of claim 8 further comprising: a braking assembly, the braking assembly controlling a brake of the rear wheel.

10. A mobile exerciser comprising:

a mobile exerciser frame;

a foot rest assembly attached to the mobile exerciser frame the foot rest assembly having a working position and a stored position;

a pedal assembly attached to the mobile exerciser frame, the pedal assembly having a working position and a stored position; and a steering assembly, the steering assembly controlling a direction of a rear wheel of the mobile exerciser, wherein the mobile exerciser is converted from a push mode to a pedal mode by moving the foot rest assembly into the stored position and the pedal assembly into the working position and the mobile exerciser is converted from the pedal mode to the push mode by moving the foot rest assembly into the working position and the pedal assembly into the stored position.

11. The mobile exerciser of claim 10 wherein the foot rest assembly further includes a hollow tube and an extension rod, the extension rod telescoping from the hollow tubing when converting the foot rest assembly from the stored position into the working position.

12. The mobile exerciser of claim 11 wherein the extension rod is secured with a clamp when the foot rest assembly is in the working position.

13. The mobile exerciser of claim 10 wherein the foot rest assembly further includes a foot rest, the foot rest being twisted 90 degrees when converting the foot rest assembly from the stored position into the working position.

14. The mobile exerciser of claim 13 wherein the foot rest assembly is secured with a push button mechanism.

15. The mobile exerciser of claim 10 wherein the pedal assembly further includes a crank shall having pedals, the pedals being removed when converting the pedal assembly from the working position into the stored position.

16. The mobile exerciser of claim 10 wherein the pedal assembly further includes a crank shaft baying a chain tensioner, the chain tensioner releasing tension on a chain when converting the pedal assembly from the work ng position into the stored position.

17. A mobile exerciser comprising:

a mobile exerciser frame;

a foot rest assembly attached to the mobile exerciser frame, the foot rest assembly having a working position and a stored position; and a pedal assembly attached to the mobile exerciser frame, the pedal assembly having a working position and a stored position, the pedal assembly including a crank shaft having a chain tensioner, the chain tensioner releasing tension on a chain when converting the pedal assembly from the working position into the stored position, wherein the mobile exerciser is converted from a push mode to pedal moving the foot rest assembly into the stored position and the pedal assembly into the working position and the mobile exerciser is converted from the pedal mode to the push mode by moving the foot rest assembly into the working position and the pedal assembly into the stored position.

18. The mobile exerciser of claim 17 wherein the foot rest assembly further includes a hollow tube and an extension rod, the extension rod telescoping from the hollow tubing when converting the toot rest assembly from the stored position into the working position.

19. The mobile exerciser claim 18 wherein the extension rod is secured with a clamp when the foot rest assembly is in the working position.

20. The mobile exerciser of claim 17 wherein the foot rest assembly further includes a foot rest, the foot rest being twisted 90 degrees when converting the foot rest assembly from the stored position into the working position.

* * * * *